US006503339B1

(12) United States Patent
Pircher et al.

(10) Patent No.: US 6,503,339 B1
(45) Date of Patent: Jan. 7, 2003

(54) METHOD FOR PRODUCING NON-GRAIN ORIENTED MAGNETIC SHEET STEEL

(75) Inventors: Hans Pircher, Mülheim/Ruhr (DE); Rudolf Kawalla, Niederbobritzsch (DE); Manfred Espenhahn, Essen (DE); Brigitte Hammer, Voerde (DE); Klaus Peters, Velbert (DE); Jürgen Schneider, Bochum (DE); Carl-Dieter Wuppermann, Krefeld (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/622,604

(22) PCT Filed: Feb. 20, 1999

(86) PCT No.: PCT/EP99/01123

§ 371 (c)(1),
(2), (4) Date: Nov. 7, 2000

(87) PCT Pub. No.: WO99/42626

PCT Pub. Date: Aug. 26, 1999

(30) Foreign Application Priority Data

Feb. 20, 1998 (DE) ..... 198 07 122

(51) Int. Cl.[7] ..... H01F 1/147
(52) U.S. Cl. ..... 148/120; 148/111
(58) Field of Search ..... 148/110–113, 120–122

(56) References Cited

U.S. PATENT DOCUMENTS 5,116,435 A * 5/1992 Nishimoto et al. ..... 148/111
RE35,967 E * 11/1998 Lauer et al. ..... 148/111
6,217,673 B1 * 4/2001 Butler et al. ..... 148/111

FOREIGN PATENT DOCUMENTS

| | | | |
|---|---|---|---|
| EP | 0 349 853 | A2 | 1/1990 |
| EP | 0 434 641 | A2 | 6/1991 |
| EP | 0 469 980 | | 2/1992 |
| EP | 0 609 190 | A1 | 8/1994 |
| EP | 0 651 061 | A1 | 5/1995 |
| JP | 56 038422 | A | 4/1981 |
| JP | 63 137652 | | 6/1988 |
| JP | 03 232924 | A | 10/1991 |
| JP | 04 187718 | A | 7/1992 |
| WO | WO 97/26377 | | 7/1997 |

OTHER PUBLICATIONS

"The Phase Transition in Isotropic Silicon Dynamosteels, Produced in the Eastern Slovak Iron Works," M. Vallo et al., *Hutnické Listy*, 29 (1974) No. 3 p. 198/202.

* cited by examiner

*Primary Examiner*—John Sheehan
(74) *Attorney, Agent, or Firm*—Proskauer Rose LLP

(57) ABSTRACT

The invention relates to a method to produce non-grain-oriented magnetic steel sheet made of thin-slab or slab casting with low specific total loss and high polarisation and favourable mechanical properties. It is a characteristic of the invention that the steel slabs are hot rolled either directly from the casting heat or after a reheating to T≧900 ° C. and two or more metal forming passes are performed in the two-phase region austenite/ferrite in the course of finishing rolling.

19 Claims, No Drawings

METHOD FOR PRODUCING NON-GRAIN ORIENTED MAGNETIC SHEET STEEL

The invention relates to a method for producing non-grain-oriented magnetic steel sheet made of thin-slab or slab casting with low specific total loss and high polarisation and favourable mechanical properties.

The term "non-grain-oriented magnetic sheet steel" is understood herein as being such according to DIN 10106 (fully finished) or 10165 (semi-finished). Moreover, more highly anisotropic types are included as long as they are not regarded as grain-oriented magnetic steel sheet (specific total loss anisotropy up to approx. 30%). This material is mainly used as core material in machines (motors, generators) with a rotating direction of magnetic flux.

For economic and ecological reasons there is a demand for a further reaching improvement of the magnetic properties (polarization J in T, specific total loss P in W/kg). The specific total losses are to be reduced and the polarisation in the respectively used induction range is to be increased. At the same time there are special requirements that are placed on the mechanical-technological properties from the viewpoint of working and processing. Cutting capability has particular relevance in this respect, e.g. during punching.

Non, low and medium silicated low-loss types with high polarisation are to be considered here. Such a strip is particularly suitable as core material for ballasts and high-efficiency motors, for railway engines, industrial drives for pumps and compressors, boosters and drives for household technology.

It is known that by additional processing steps such as hot strip annealing or two-stage cold-rolling with intermediate annealing an improvement of the magnetic properties is achieved.

In WO 96/00306 it is proposed for steels with the main alloying elements of silicon, manganese and aluminium to finish-roll the hot strip for magnetic steel sheet in the austenite range and to perform the coiling at temperatures above the complete conversion into ferrite. Moreover, a direct annealing of the coil from the rolling heat is provided. In this way a final product with favourable magnetic properties is obtained. However, increased costs must be taken into account due to the high energy expenditure during the heating prior to and during the hot rolling and due to the alloying additions.

EP 0 469 980 B1 demands increased coiling temperatures in combination with an additional hot strip annealing. Useful magnetic properties are already set at low alloy contents. An increased coiling temperature and the additional hot strip annealing require an increased energy expenditure and thus cause higher costs.

In EP 0 651 061 B2 the setting of a cubic texture which is twisted by 45° about the normal of the sheet is proposed. Particularly interesting magnetic properties are obtained with respect to polarisation. This requires a complex method, however. In addition to increased final rolling and coiling temperatures it is necessary to perform additional steps during cold rolling such as preheating and intermediate annealing and dressing once or several times.

EP 0 511 601 B1, which is aimed at higher silicon and aluminium contents (Si+2 Al≧2%), provides hot strip annealing at particularly high temperatures above 1000° C. Expensive alloying elements must consequently be used and very high temperatures with additional annealing of the hot strip must be applied.

The invention is now based on the objective of providing a magnetic steel sheet in a cost effective manner with the combination, suitable for many fields of application, of high polarisation, low specific total loss and favourable mechanical properties.

In order to achieve this object it is provided by the generic method in accordance with the invention to hot roll the casting directly from the casting heat or, after a renewed heating to a temperature of T≧900° C., and to perform two or more metal forming passes in the two-phase range austenite/ferrite in the course of finishing rolling in order to set a state of the hot strip which is favourable with respect to the properties of the magnetic steel sheet. In order to fulfil these prerequisites, the steel must be alloyed in such a way that an austenite share of not less than 10% is obtained during the hot rolling temperature. This is to be effected by a respective adjustment of the alloying additions of austenite and ferrite-forming elements at a basic composition of (Si+2 Al)≦3%. The steel melts thus used contain 0.001 to 0.1% C, 0.05 to 3.0% Si, up to 0.85% Al with Si+2 Al≦3.0%, 0.05 to 2.0% Mn, remainder of iron and the usually companion elements and alloying additions of P, Sn, N, Ni, Co, Ti, Nb, Zr, V, B, Sb up to a total of 1.5%.

During slab casting there is usually a renewed heating to at least 900° C. so that austenite is formed and the finishing rolling can be performed in accordance with the invention in the $\gamma/\alpha$ two phase region. In the production of thin slabs or strip, the material is usually also heated to at least 900° C. prior to finishing rolling by using the casting heat for the reasons as stated above.

Thin slab or strip casting offer the following additional advantages as compared with conventional slab casting: Due to the lower cooling time until the complete solidification, the dendrite arm distances are smaller and there are thus fewer enhancement, thus making the material more homogeneous. Due to the lower thickness of the slabs and the possibility of using the casting heat, the hot strip rolling is shortened and savings in cost are achieved. In the case of a respective design of the thin slab casting and rolling installation, a wider range of final rolling and coiling temperatures and lower hot strip thicknesses can be set. At lower hot strip thicknesses of ≦1.5 mm the hot rolling can occur at final rolling speeds of over 10 m per second in order to obtain a high productivity.

By providing a roller lubrication in at least one of the last three hot rolling passes of the finishing rolling, a more homogeneous structure can be obtained over the cross section due to a lower shear deformation. Since in addition the roll separating force is reduced, a higher thickness reduction to a lower end thickness is possible.

In a further claim the finishing rolling is completed by at least one metal forming pass with a dimensional change $\epsilon_h=(h_i-h_{i+1})/h_i>10\%$ in the ferrite region. If the hot rolling is completed by one or several metal forming passes in the ferrite region and the hot strip is coiled at temperatures below 650° C., then this leads to a solidified hot strip state and to a suppression or fine dispersion of the precipitations. This can reduce the subsequently necessary degree of cold rolling. The hot strip can principally be cold rolled in one or several stages with intermediate annealing to its end thickness. These measures set a finer structure, thus improving the cutting and punching capabilities of the cold strip.

A limitation of the Si content of the steel to 0.05 to 1.6% Si is appropriate in cases when otherwise no two-phase region is present anymore in case of respective shares of other components of the composition. Because the reheating temperature of the steel slabs lies in the austenite region it is ensured that the required metal forming passes are performed in the two-phase region.

If the steel slab is cooled directly from the casting heat to temperatures below 900° C. and is hot rolled after a reheating up to the austenite region, coarse precipitations are formed. In contrast to finer precipitations, such coarse precipitations can lead to improved magnetic properties of the magnetic steel sheet. The latter applies in particular when the reheating temperature is not more than 1150° C. At such a low chosen temperature, the previously formed coarse precipitations are prevented from dissolving again.

The thus produced hot strip with a thickness of up to 6 mm is coiled at coiling temperatures of either below 650° C. or in the range of 650° C. to Ar1, depending on its intended purpose. If the strips were coiled at high temperatures, the coils can thereafter be cooled at room temperature in static air or heat-treated directly from the coil heat. The heat treatment can occur by a delayed cooling of a maximum of 100° C. per hour under a covering cap down to 600° C. or by a hot insert in a furnace. The furnace temperature can also lie above the coiling temperature.

Coiling temperatures of between 650° C. and the Ar1 temperature which varies with the alloy shares can replace hot strip annealing in part or in full. A short distance to the coiler of 40 m and below for example in combination with high final rolling speeds allows for high coiling speeds particularly in a continuous casting and rolling plant, which cannot be set in conventional mill trains, in particular at low strip thicknesses. In this way the hot strip shows a softening already in the coil, thus positively influencing the property-relevant structural features such as grain size, texture and precipitations. The improvement of magnetic properties which is achieved with the method in accordance with the invention as compared with conventional methods is linked to a reduction of time required and energy employed in the production of the magnetic steel sheet.

Various approaches are possible for producing the magnetic steel sheet: The hot strip in accordance with the invention can be used directly as a magnetic steel sheet. It can be used with or without rerolling during final annealing after processing (semi finished). The hot strip can be annealed before this step. In further alternatives the hot strip is cold rolled to final thickness in one or several stages with intermediate annealing, with the aforementioned production steps being performed afterwards. In these alternatives the hot strip can be used in the rolled state or after a hot strip annealing. If the afterforming and the final annealing after processing are omitted, the annealing is to be designed already after the rolling to final thickness in such a way that the required property profile is set (fully finished). All annealings can be performed either in a top hat furnace or through-type furnace at temperatures over 650° C.

EXAMPLES

Table 1 shows the magnetic property values, specific total loss (P) and polarisation (J) which were achieved according to a conventional method and according to the method in accordance with the invention.

TABLE 1

| | Product | Conventional method | | | Method acc. to invention | | | | |
|---|---|---|---|---|---|---|---|---|---|
| Alloy | [mm] | $P_{1.0}$/W/kg | $P_{1.5}$/W/kg | $J_{2500}$/T | $P_{1.0}$/W/kg | $P_{1.5}$/W/kg | $J_{2500}$/T | $Ar_3$/° C. | $Ar_1$/° C. |
| 0.15% Si | sf:0.65 | 2.41 | 6.03 | 1.633 | 2.38 | 5.99 | 1.662 | 915 | 845 |
| 0.1% Al | | | | | 2.32 | 5.93 | 1.656 | | |
| 0.35% Mn | | | | | | | | | |
| 0.60% Si | ff:0.5 | 2.37 | 5.2 | 1.68 | 2.32 | 5.01 | 1.692 | 1050 | 945 |
| 0.25% Al | with HSA | | | | 2.28 | 4.95 | 1.690 | | |
| 0.25% Mn | | | | | | | | | |
| 1.3% Si | ff:0.5 | 2.62 | 5.74 | 1.623 | 2.13 | 4.55 | 1.668 | 1050 | 965 |
| 0.12% Al | | | | | 2.52 | 5.41 | 1.651 | | |
| 0.2% Mn | | | | | 2.53 | 5.44 | 1.647 | | |
| | ff:0.5 | 2.2 | 4.75 | 1.67 | 2.03 | 4.35 | 1.683 | | |
| | with HSA | | | | | | | | |
| 1.8% Si | ff:0.5 | 1.91 | 4.22 | 1.587 | 1.84 | 4.02 | 1.617 | 1120 | 1050 |
| 0.35% Al | | | | | | | | | |
| 0.20% Mn | | | | | | | | | |

The examples show the improvement that can be achieved by the application of the method in accordance with the invention for semi-finished (sf) and for fully finished (ff) standard qualities without hot strip annealing and with a conventional hot strip annealing (HSA). Higher polarisation values (J) and mostly lower specific total losses (P) are achieved by the production approach in accordance with the invention. The two last columns of Table 1 state the transformation temperatures Ar3 and Ar1 for the different alloys which characterise the limits of the two-phase region of austenite/ferrite.

What is claimed is:

1. A method to produce hot-strip from casting in slabs, thin slabs, or strip made of a steel with (in mass %):

0.001 to 0.1% C 0.05 to 3.0% Si up to 0.85% Al with Si+2 Al≦3.0%

0.05 to 2.0% Mn, the balance being substantially iron, impurities and alloying additions of P, Sn, N, Ni, Co, Ti, Nb, Zr, V, B, Sb up to a total of 1.5% comprising:

hot rolling the steel slabs, the thin slabs or the strips either directly from casting heat or after a renew heating to T≧900° C.; and performing two or more metal forming passes in a two-phase region austenite/ferrite in a course of a finishing rolling step to produce the hot strip.

2. A method according to claim 1, wherein the hot rolling is completed in the ferrite region by at least a last metal forming pass of the finishing rolling with a form change of >10%.

3. A method according to claim 1, wherein the steel contains 0.05 to 1.6% Si.

4. A method according to claim 1, wherein a reheating temperature of the steel slabs, thin slabs, or the strips lies in the austenite region.

5. A method according to claim 1, further comprising cooling the steel slabs, thin slabs or the strip directly from the casting heat to temperatures below 900° C.; and hot rolling the steel slabs, thin slabs or the strip after a reheating up to the austenite region.

6. A method according to claim 5, wherein the reheating temperature is a maximum of 1150° C.

7. A method according to claim 1, further comprising performing three hot rolling passes, wherein at least one of the three hot rolling passes of the finishing rolling step is performed with roller lubrication.

8. A method according to claim 7, further comprising performing the last pass of the finishing rolling step with roller lubrication in the ferrite region.

9. A method according to claim 1, further comprising coiling the hot strip at a temperature between 650° C. to Ar1.

10. A method according to claim 1, further comprising annealing the hot strip at a temperature between 650° C. to Ar3.

11. A method according to claim 10, further comprising annealing the hot strip directly after coiling in a coil.

12. A method according to claim 10, further comprising first cooling the hot strip and reheating the hot strip for the annealing.

13. A method according to claim 10, further comprising annealing the hot strip from the rolling heat in line.

14. A method according to claim 10, further comprising cooling a coiled strip under a covering cap with a speed of not more than 100° C. per hour down to 600° C.

15. A method according to claim 1 further comprising coiling the hot strip at temperatures <650° C.

16. A method according to claim 1 further comprising further processing the hot strip by cold rolling in one or several stages, optionally with intermediate annealing.

17. A method to produce a fully finished magnetic sheet steel according to claim 13, further comprising fully finishing a hot rolled or a hot-and cold rolled strip to final thickness under protective furnace gas above 650° C.

18. A method to produce a semi-finished magnetic steel sheet according to claim 13 further comprising recrystallization annealing of a hot rolled or a hot and cold rolled strip in a top hat or through furnace under protective furnace gas and thereafter straightening or rerolling the hot rolled or the hot and cold rolled strip.

19. A method according to claim 17, further comprising decarbonizing annealing of the hot rolled or the hot-and cold rolled strip prior to final annealing.

* * * * *